United States Patent [19]

Horwinski

[11] 4,038,582

[45] July 26, 1977

[54] INTERNALLY ILLUMINATED SWITCH PLATE

[75] Inventor: Elwood R. Horwinski, Cheshire, Conn.

[73] Assignee: Product Concepts, Inc., Middlebury, Conn.

[21] Appl. No.: 608,742

[22] Filed: Aug. 28, 1975

[51] Int. Cl.[2] ..... F21V 33/00; H05B 37/00

[52] U.S. Cl. ..... 315/129; 200/317; 240/2 SP; 315/136

[58] Field of Search ..... 315/129–132, 315/136, 362; 240/2 S, 2 SP; 200/310, 315, 317

[56] References Cited

U.S. PATENT DOCUMENTS 2,839,670 6/1958 Gladstone ..... 315/129 X

*Primary Examiner*—Eugene R. La Roche
*Attorney, Agent, or Firm*—H. Gibner Lehmann; K. Gibner Lehmann

[57] ABSTRACT

An internally illuminated switch plate for providing visual indications of the on-off condition of an electrical wall switch. The plate comprises a wall plate in the form of a flat slab adapted to overlie the wall fixture and constituted of material which conducts light. A small recess in the rear surface carries a neon glow lamp, and a second recess carries a resistor. The glow lamp and resistor are connected in series, and this assemblage in turn connected across the terminals of the switch. Connections to the neon lamp and resistor are made via tracks of conductive paint disposed in grooves in the rear surface of the slab. The tracks extend to two terminals of the slab, from which flexible leads are run to terminals of the switch. The arrangement is such that when the switch is off, the lamp is energized by the voltage normally appearing across the switch terminals, to thus provide a visual indication of the on-off condition of the switch.

1 Claim, 5 Drawing Figures

INTERNALLY ILLUMINATED SWITCH PLATE

BACKGROUND

This invention relates generally to electrical wall switching fixtures for homes, offices or plant facilities, and more particularly to attachments which monitor or indicate the on-off condition of switching fixtures.

Prior industrial-type switches have employed neon glow lamps which were connected across the terminals of a switch (through a suitable current-limiting resistor) such that the voltage normally appearing across the terminals, when the switch was off, illuminated the lamp. In the past it has been a problem to locate the lamp in a position where it could be readily seen while at the same time being somewhat concealed and out of the way. Any wiring of the lamp leads directly to the terminals of the switch has proved to be unsatisfactory in that the latter often accommodate several leads of No. 12 or No. 14 gauge wire, which are large compared to the fine wire making up the leads of the lamp or its series resistor.

Efforts to locate a lamp in the (translucent) toggle handle or operating member of the switch have met with some success, although this involves the construction of a special switch having provision for holding the lamp in such predetermined position. In existing facilities, installation of such illuminated toggle switches involves a complete substitution of the existing switch mechanism, which often entails considerable expense with high labor costs.

SUMMARY

The above disadvantages and drawbacks of prior indicating switch devices are obviated by the present invention, which has for an object the provision of a novel and improved illuminated switch plate for monitoring the on-off condition of a wall switch or the like, the device being extremely simple in construction, reliable in operation, and useable with existing switch structures without the need for extensive replacement or rewiring. A related object of the invention is to provide a switch plate as above characterized, wherein the lamp component is securely retained and unlikely to be inadvertently jarred loose or broken, or the leads thereof pinched between the switch plate and the outlet box.

The above objects are accomplished by the provision of a unique illuminated switch plate for wall fixtures and the like, comprising a flat slab adapted to overlie the fixture so as to constitute a wall plate thereof, a neon glow lamp carried by the slab, and resistive means also carried by the slab and disposed behind its front surface. The slab is preferably constituted of light-conducting material, and includes a shallow recess behind its front surface, wherein the lamp is received and mounted. The resistive means is connected with the lamp, and this assemblage in turn connected across the terminals of a switch over which the slab is disposed, by means flexible electrical leads. The latter preferably have sufficient length to enable them to be connected to the switch with the slab removed, and then folded back on themselves when the slab is installed over the switch and outlet. The arrangement is such that the lamp is energized by the voltage normally appearing across the terminals of the switch when the latter is off. Due to the fact that both the lamp and resistive means are carried by the slab and not the switch, the present device is useable in existing installations, merely by substitution of just a switch plate rather than a complete switch mechanism. As a result, a minimum amount of rewiring and disruption of the existing circuits are involved. Also, by virtue of the lamp and resistive means being recessed in the slab, the likelihood of breakage of the lamp and of short circuits due to pinching of leads is greatly minimized.

Other features and advantages will hereinafter appear.

In the drawings, illustrating a preferred embodiment of the invention:

Figure 1:
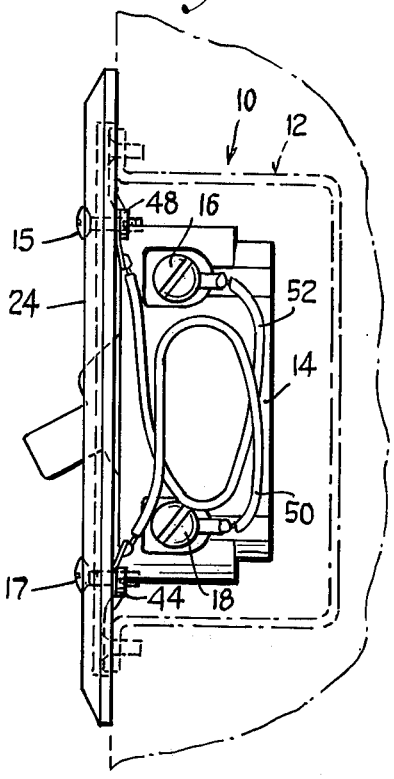
FIG. 1 is a side elevational view of the improved illuminated switch plate of the present invention, shown overlying a wall outlet in which there is carried an electrical switch.

Referring particularly to FIG. 1, there is illustrated a wall switch generally designated by the numeral 10, including an outlet box 12, and a switch member 14 having a pair of terminals 16, 18, adapted to be connected to an electrical circuit to be controlled (not shown) such as an electric light or other appliance.

Figure 2:
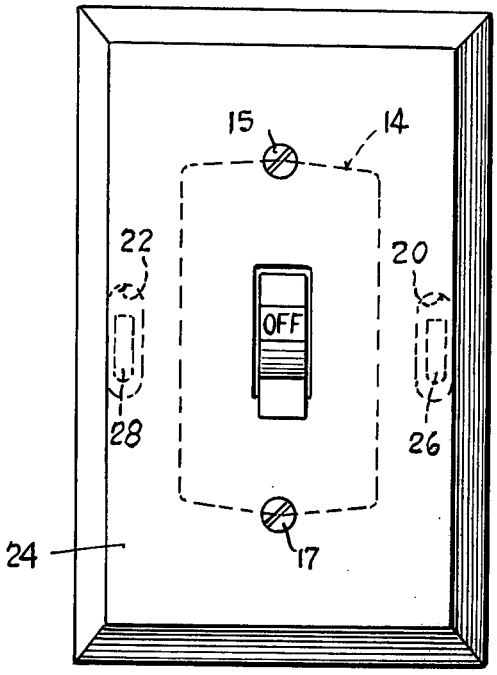
FIG. 2 is a front elevational view of the switch plate of FIG. 1.
Figure 3:
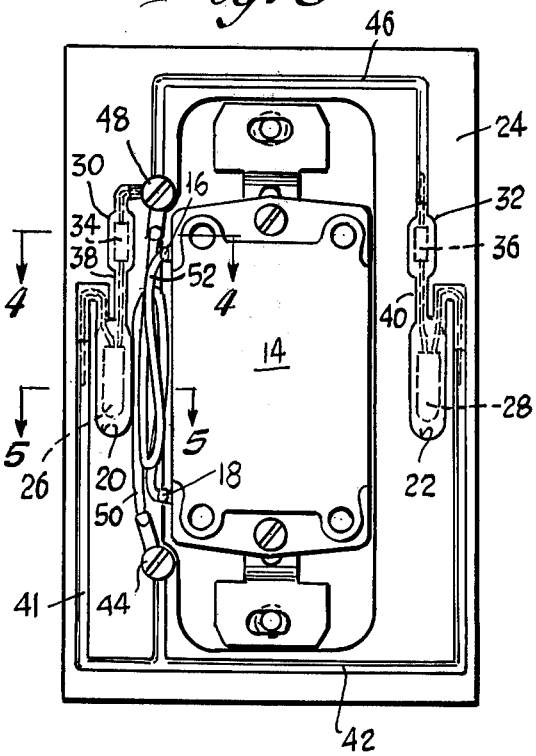
FIG. 3 is a rear elevational view of the plate of FIG. 1.
Figure 4:
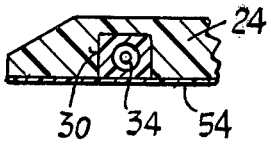
FIG. 4 is a section taken on line 4—4 of FIG. 3.
Figure 5:
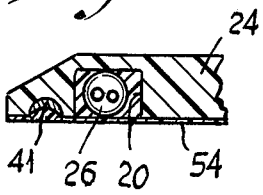
FIG. 5 is a section taken on line 5—5 of FIG. 3.

Considering FIGS. 1–3 and in accordance with the present invention there is provided a novel and improved illuminated switch plate for indicating the on-off condition of the switch 14, the plate including a substantially flat slab 24 adapted to overlie and be secured to the outlet box by means of screws 15, 17, so as to constitute a wall plate therefor. As shown particularly in FIG. 3, the plate includes shallow recesses 20, 22 in its rear surface, which accommodate a pair of tubular neon glow lamps 26, 28 respectively. The demensions of the slab 24 and recesses 20, 22 are such that the lamps can be completely flush with the plane of the rear surface whereby no portions of the lamps will protrude above this surface. Additional recesses 30, 32 are provided, and receive resistors 34, 36 respectively. Extending between the recesses 20 and 30 is a groove 38 which is adapted to accommodate one lead of the resistor and one lead of the lamp in coextensive relation. Similarly, a second groove 40 extends between the recesses 22 and 32 to accommodate one lead of the lamp 28 and one lead of the resistor 36. These are joined by suitable means such as solder or conductive epoxy, and the lamps and resistors are retained in the respective recesses by suitable cement.

Referring again to FIG. 3, additional grooves 41, 42 are provided in the rear surface, and are filled with conductive epoxy, constituting a conductive strip. A contact 44 in the form of a lug and screw terminal make electrical connection with the conductive epoxy in the grooves 41, 42. Similarly, an additional groove 46 is provided, extending to the remaining leads of the resistors 34, 36. This groove is also filled with conductive epoxy which extends to a second contact 48 in the form of a lug and screw terminal. Flexible leads 50, 52 extend from the contacts 44, 48 respectively to the terminals of the switch. The arrangement is such that the resistor 34 is in series with the lamp 26, the same being true of resistor 36 and lamp 28, with the two assemblages being connected across, or in parallel with the terminals of the switch. Both lamps are thus capable of being energized (through their respective resistors) by the voltage which normally appears across the terminals of the switch when it is open.

Switches of the type illustrated in FIGS. 1–3 are commonly utilized in the electrical industry, being wall switches of the single pole variety which are conventionally included in the "hot" side of a light circuit (not shown), to control the illumination of a light fixture. Such lighting circuits are well known, and have been in use for many years. The conduit or outlet box 12 receives a BX or other supply cable which has the 115-volt energy, and a second BX or other cable leaves the box and goes to the light fixture. One wire of each of the cables (the ground wire) forms a junction, these being connected together; and the remaining wires from the two BX cables are connected respectively to the switch terminals 16, 18. Such arrangement is not illustrated herein since it is conventional and understood, having been in use for many years. This known circuitry places the switch 14 in series, in the lighting circuit. Thus, when the switch 14 is open there appears a voltage across its terminals 16, 18 if the lamp of the lighting circuit is operative. However, if the lamp of the lighting circuit is burned out and the switch 14 is open, there will be no voltage occurring across the terminals 16, 18. Use of this conventional arrangement has been made, in the past, to operate a pilot or monitor light, as is well known to those skilled in the art. Accordingly, further explanation of the lighting circuit used with the switch 14 and switch plate 24 of the present invention is not given here. Closing of the switch, of course, short-circuits the lamps 26, 28, and as a consequence there is provided at all times a visual indication of the on-off condition of the switch inasmuch as the open condition of the switch results in a voltage appearing across the switch terminals 16, 18 which, then, illuminates the lamps 26, 28. And, of course, with the switch 14 closed the lamps 26, 28 are short-circuited.

The slab is preferably constituted of translucent, but not clear, plastic. With proper selection of the material, the light from the lamps 26, 28 will be diffused by the slab to yield a soft glow effect. The screws making up the contacts 44, 48 can be threaded into tapped holes in the rear surface of the slab, to simplify the fabrication and assembly of the plate. A coating of resin 54 can be applied to the rear surface of the slab 24, so as to insulate the contacts 44, 48, the lamps, and connecting leads from inadvertent contact with the outlet box or wiring contained therein. Preferably the leads 50, 52 have sufficient length to enable them to be wired to the terminals of the switch with the plate removed, after which the latter can be secured to the switch device by means of the screws 15, 17. This construction has the distinct advantage that the switch plate can readily be employed in existing installations, merely by removing the old plate, wiring the leads 50, 52 of the new plate to the terminals of the switch, and screwing the new plate in position. As a result, no expensive replacement of switch mechanisms is required, and the installation is simple and foolproof.

From the above it can be seen that I have provided a novel and improved illuminated switch plate which is extremely simple in construction, reliable in operation, and which is readily adaptable to many existing installations without the need for extensive rewiring or replacement of toggle switch mechanisms. The device is thus seen to represent a distinct advance and improvement in the technology of indicating type switch devices.

Variations and modifications are possible without departing from the spirit of the invention.

I claim:

1. An illuminated switch plate for wall fixtures and the like, comprising in combination:

a. a flat slab adapted to overlie and be secured to the fixture so as to constitute a wall plate thereof, b. said slab having a shallow recess disposed behind the front surface thereof, and being constituted of a material which conducts light, c. a neon glow lamp disposed in said recess, d. resistive circuit means carried by the slab, disposed behind its front surface and connected with said glow lamp, and e. electrical leads connected with said resistive circuit means and adapted for attachment to the terminals of a switch over which the slab is disposed, whereby the lamp will become illuminated by the voltage appearing across the switch terminals when the switch is open, thus providing a visual indication of the condition of the switch, f. said slab having an additional recess, g. said resistive circuit means comprising a resistor disposed in said additional recess and connected in series with said lamp, h. means physically securing said resistor in said additional recess, i. said slab having grooves on its rear surface, j. said electrical leads comprising conductive strips of conductive paint disposed in said grooves, connected with said resistor and said lamp, k. a pair of electrical contacts carried by said slab, and being electrically connected with said conductive strips, l. said electrical leads further comprising a pair of flexible wires connected respectively to said contacts and adapted to be connected to the terminals of the switch, m. said lamp, said resistor and said conductive paint all lying substantially entirely within the confines of the slab whereby the likelihood of damage to the lamp and resistor due to inadvertent jarring, and the likelihood of breakage or shortcircuiting of their leads are substantially reduced.

* * * * *